US005612705A

United States Patent [19]

Openlander

[11] Patent Number: 5,612,705

[45] Date of Patent: Mar. 18, 1997

[54] WIDE-BANDED BASE STATION ANTENNA

[75] Inventor: Wayne R. Openlander, Chicago, Ill.

[73] Assignee: Antenex, Inc., Glendale, Ill.

[21] Appl. No.: 584,545

[22] Filed: Jan. 11, 1996

[51] Int. Cl.[6] ..... H01Q 9/04

[52] U.S. Cl. ..... 343/790; 343/791; 343/749

[58] Field of Search ..... 343/790, 791, 343/792, 749, 850, 872; H01Q 9/04

[56] References Cited

U.S. PATENT DOCUMENTS

| | | | |
|---|---|---|---|
| 2,296,356 | 7/1941 | Lindenblad | 343/790 |
| 3,315,264 | 4/1967 | Brueckmann | 343/791 |
| 4,835,539 | 5/1989 | Paschen | 343/700 MS |
| 4,968,991 | 11/1990 | Yamazaki | 343/791 |

OTHER PUBLICATIONS

Maxrad's catalog specification sheets for Ringo and MBS/MBX antennas. (Date is not available).

M. Taguchi et al.; "Sleeve Antenna with Ground Wires," *IEEE Transactions on Antennas and Propagation;* vol. 39, No. 1, Jan. 1991; pp. 1–7.

*Antennas Engineering Handbook,* excerpted pp. 43–27 to 43–31 (Date is not available).

*Primary Examiner*—Donald T. Hajec
*Assistant Examiner*—Tan Ho
*Attorney, Agent, or Firm*—Cislo & Thomas

[57] ABSTRACT

A base station antenna includes a matching network that broadbands transmission without requiring adjustment. Using a one-quarter wavelength (¼ λ) or less sperrtopf sleeve in a coaxial arrangement, broadbanding is achieved by adding a second conductor parallel to the transmission line center conductor. A ring inductor is tapped at one end off-center by the second conductor. The inductor's step-up end is connected to the antenna with the primary end connected to the transmission line center conductor. Mutual inductance may be present, but is not required, between the transmission line center and second conductors. Fringing capacitance between the antenna and the sleeve establishes an "L" network in conjunction with the inductor. To protect the inductor from the elements, it is placed inside the antenna near the sleeve.

8 Claims, 5 Drawing Sheets

WIDE-BANDED BASE STATION ANTENNA

BACKGROUND OF THE INVENTION

1. Field of the Invention

The present invention relates to antennas, and more particularly to a type of base station antenna that can be easily assembled and disassembled for transportation to different sites and retuned to frequency on location.

2. Description of the Related Art

Base station antennas are usually mounted on the sides of buildings, on short towers, or on tripods. The radiating section of the antenna is open to the air and is made from sections of telescoping aluminum tubing, using hose clamps to fix the sections in place.

These antennas generally fall into three general electrical types:

Type 1: Antennas with a radiating element ¼ wavelength long or a collinear antenna with a first element ¼ wavelength long. These antennas are fed at a point of lowest impedance and therefore require a system of radials or counterpoise or a combination of both. Impedance matching is often achieved by slanting the radials at a downward angle or by using a sleeve coaxial with the transmission line to effect a dipole antenna. This type of antenna has the lowest effective gain of the three types described here.

Type 2: Antennas with a radiating element made antiresonant, or about ½ wavelength long, or a collinear antenna with an antiresonant first element. These antennas are fed at a point of highest impedance and require no radials or counterpoise system. An "L" network is used to match the feedline impedance to the transmission line. A fringing capacitance between the antenna and the base forms the capacitor. The inductor part of the "L" network is usually external to the antenna so it can be adjusted for matching. This antenna has a gain of several dB over the Type 1 antennas described above.

Type 3: Antennas with a radiating element made about ⅝ wavelength long so that the real part of the input impedance is 50 ohms and the reactive part is capacitive or, if collinear, tuned in the same fashion. These antennas may be matched by inserting a series inductance which tunes out the capacitive portion of the reactance and requires a ground plane as with Type 1 antennas. These antennas have a slight gain improvement over Type 2.

The requirement for a ground plane, with its need for mounting area and the tendency of these antennas to get bent, makes Type 1 and 3 antennas unattractive for temporary installations. The ½-wavelength antennas can be matched to a transmission line with an inductor outside the antenna housing so it can be easily adjusted by the user. This may also be done with the network inside the mounting sleeve if the antenna is fixed tuned, and the frequency bandwidth of an antenna may be increased by adding a compensating network.

Typical commercial versions of Type 2 antennas, implementing the application of radials and/or sleeves for counterpoises, have a typical "L" network made from the transmission line and enclosed inside a sleeve used to mount an antenna.

Some Type 2 antennas use a "ring"-style matching network and feedline connection exposed to the weather. The "L" matching network uses the fringe capacitance between the antenna radiator and the mounting sleeve. Others use an "L" network, a shunt capacitor, and a series inductor to match a high impedance to a 50 ohm impedance.

There are also antennas that replace the radials on a ¼-wavelength antenna with a sleeve called a "sperrtopf." This sleeve is ¼ wavelength long at the antenna's operating frequency and may be reversed. Its purpose is to choke current from the coax of the feedline. Such antennas, often used as base station antennas with internal matching networks, use mounting sleeves that are ¼ wavelength long.

There are antennas which use an internal matching network assembled inside a ¼-wavelength tube, or sleeve. A tap on the transmission line acts as a capacitor, and the transmission line having a $Z_0$ somewhat higher than 50 ohms replaces the inductor. The sleeve also acts as an RF (radio frequency) choke, keeping RF current off the feedline.

U.S. Pat. No. 4,835,539 issued to Paschen on May 30, 1989, for a "Broadbanded Microstrip Antenna Having Series-Broadbanding Capacitance Integral with Feedline Connection," describes a broad-banding network.

SUMMARY OF THE INVENTION

The present invention provides a base station antenna having broad-banding characteristics. With such broad-banding characteristics, the matching network no longer has to be adjusted for useful applications of the present antenna. Additionally, the matching network is mounted internally to a mounting sleeve and so has the additional advantage of being protected from the weather. Furthermore, the DC ground feature is kept in the present antenna. When compared to antennas constructed according to older designs, the present antenna yields an operating bandwidth one hundred fifty percent (150%) greater than those previous antennas.

Generally, one-quarter (¼) wave antennas are capacitive below resonance, resistive at resonance, and inductive above resonance. In order to achieve broad-banding, the present invention supplements an antenna with a broad-banding network that is inductive below resonance and capacitive above resonance. The patent to Paschen, above, describes calculation of the absolute maximum bandwidth and is incorporated herein.

While theoretical limits are difficult to achieve in reality, the present invention provides an actual way to obtain good broadbanding results for base station antennas.

OBJECTS OF THE INVENTION

It is an object of the present invention to provide greater broadbanding operations in base station antennas.

It is an additional object of the present invention to provide a matching network that changes reactance to complement the change in reactance in the associated antenna that occurs over a varying frequency range.

These and other objects and advantages of the present invention will be apparent from a review of the following specification and accompanying drawings.

DESCRIPTION OF THE PREFERRED EMBODIMENT(S)

Figure 1A:
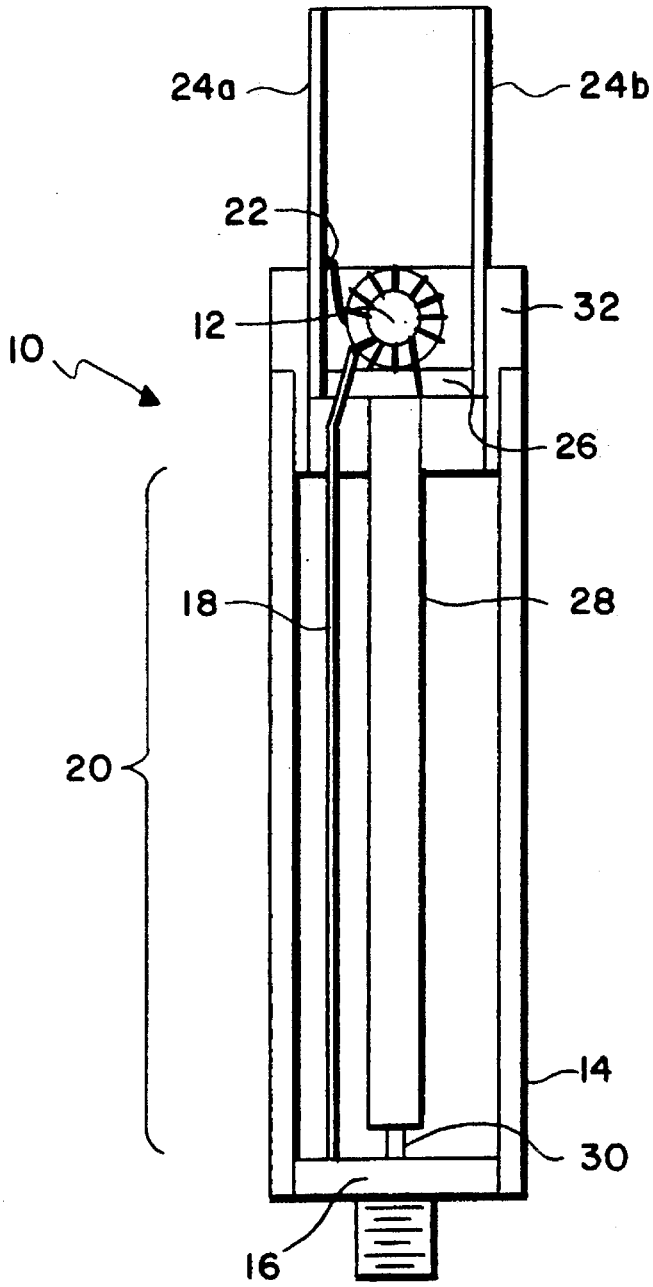
FIG. 1*a* shows a side cross-section view of the antenna of the present invention.
Figure 1B:
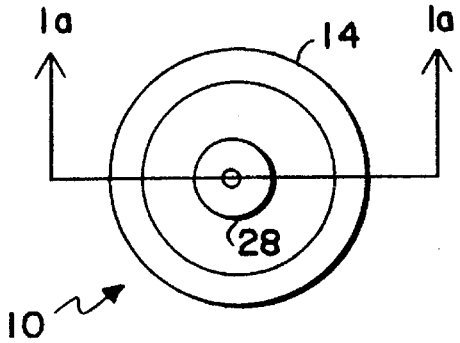
FIG. 1*b* shows a top cross-section view of the antenna shown in FIG. 1*a*.

As shown in FIG. 1*a*, an antenna assembly 10 has an inductor 12 inside a sleeve 14 while keeping its DC ground 16. FIG. 1*b* shows a top view of the cross section shown in FIG. 1*a*. The inductor 12 acts as power divider to add a bandwidth-expanding network to the antenna 10. The inductor is tapped at a tap 18, not in the center but to one end. The section 20 between tap 18 and conductor 28 may or may not have mutual inductance. The inductor 12 is fed at the tap 18. The step-up end 22 is connected to the exposed antenna radiator 24*a*, and the primary end 26 is connected to a transmission line conductor 28 that couples to the feedline center conductor 30 inside the mounting sleeve 14.

A plastic insulator 32 holds the antenna radiator 24 to a mounting sleeve 14. As the antenna radiator 24*a, b* travels partway into the cavity defined by the plastic insulator 32, a fringe capacitance between the antenna radiator 24*a, b* and the sleeve 14 arises to form an "L" network with the inductor 12. With the "L" network so formed, the metal mounting sleeve 14 can be much less than the usual ¼ wavelength at operating frequency, yet still retain broadbanding characteristics.

The advantages are that the "L" matching network no longer has to be adjusted and is now internal to the mounting sleeve so it is protected from the weather. The DC ground feature is kept, and the assembled antenna has up to 1½ times (150%) the operating bandwidth when compared to the older antennas.

The principle (of having an appropriately tapped inductor 12 with a fringing capacitance formed between the antenna radiator 24*a, b* and the sperrtopf sleeve 14) can be applied to antennas of Types 1 and 3 and is obviously not limited to adjustable base station antennas. The sleeve 14 can be any length less or equal ¼ wavelength. The bandwidth expansion improves as the length approaches ¼ wavelength, but antenna assembly 10 frequency becomes less tunable. In the present case, the bandwidth-expanding network is not critically tuned, with the result that the antenna's frequency may be changed, by changing the length of the radiators 24*a, b* over a considerable range, without requiring any readjustment of the matching network.

The general principle of broad-banding is to synthesize a network with a reactance that changes with frequency in complement to the antenna's reactance and, conversely, to design an antenna whose reactance changes in a way that can be so complemented.

The idea of using a ¼-wavelength transmission line sleeve has been described previously; but the idea of making the sleeve 14 shorter, loosely coupling it to another transmission line 30, then using an inductor 12 to effectively further lengthen the line, and finally using another optional inductor 20 to adjust the antenna's impedance change so they somewhat cancel is believed to be, as yet, unseen in the art.

FIGS. 2*b*, 3*b*, 4*c*, and 5*c* depict some Smith Charts to show the transmission characteristics of the present invention.

Figure 2A:
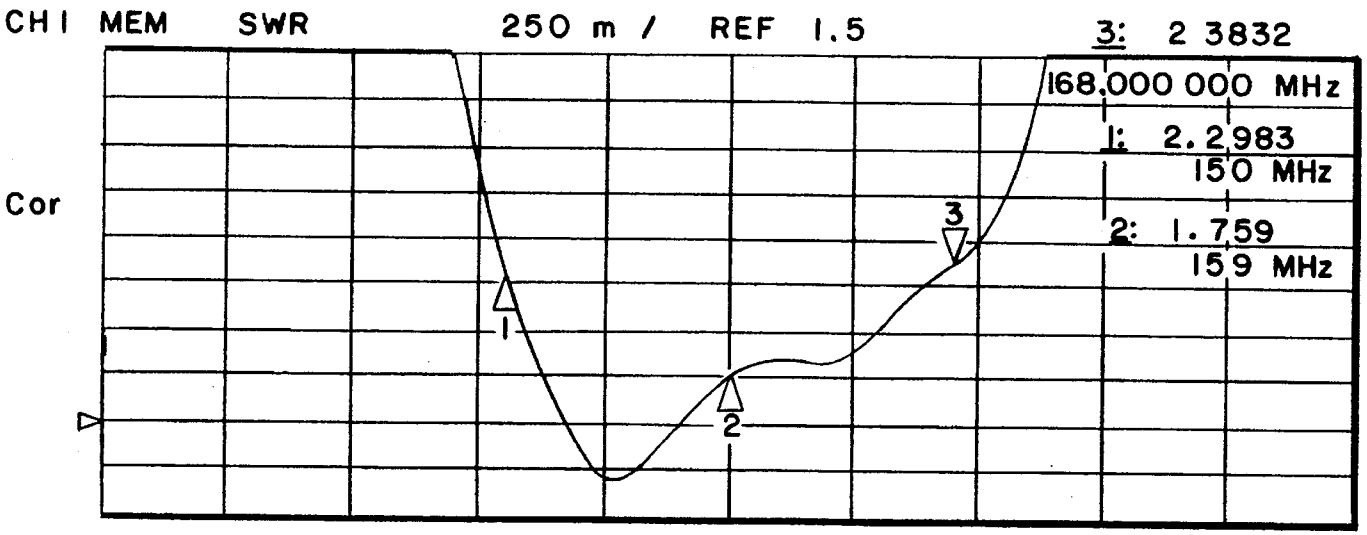
FIGS. 2*a* and 2*b* show frequency response charts for the antenna of the present invention when broad-banded in a generally optimum manner.
Figure 2B:
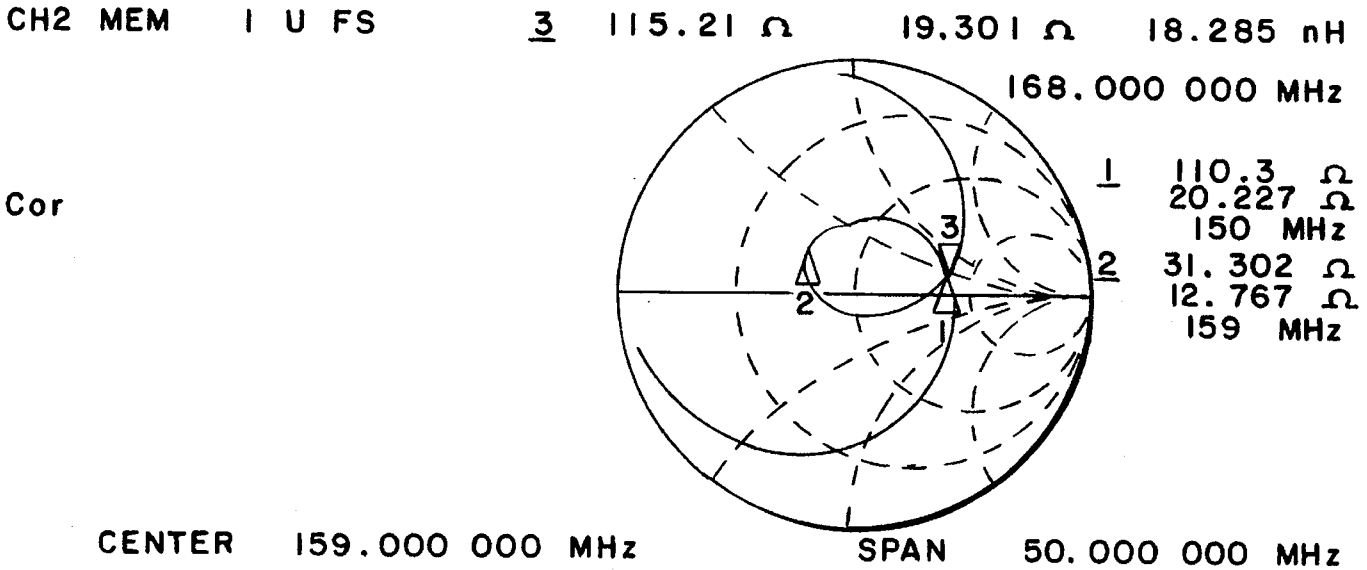

FIG. 2*b* shows the characteristic "knot" of a near-perfectly broad-banded antenna.

Figure 3A:
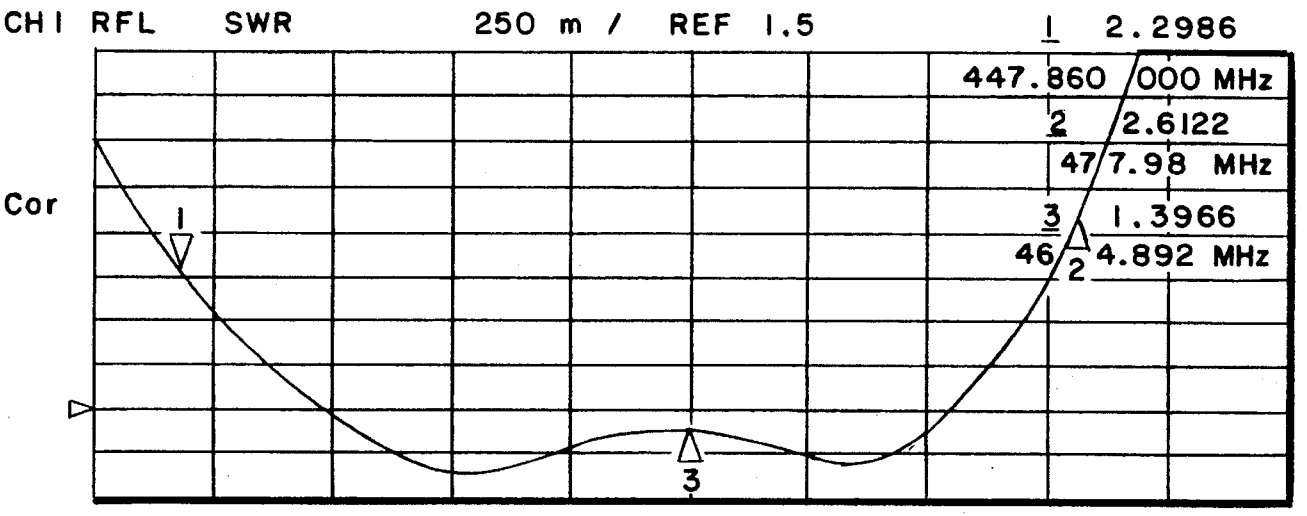
FIGS. 3*a* and 3*b* show frequency response charts for the antenna of the present invention when broad-banded in a less than optimum manner.
Figure 3B:
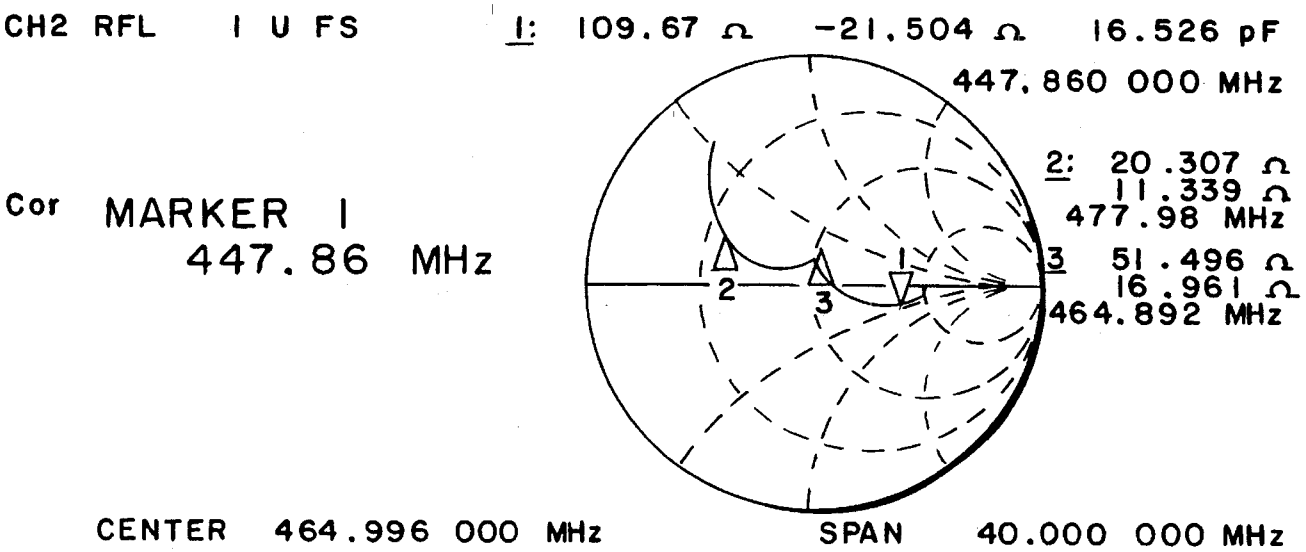

FIG. 3*a* shows a response curve for the antenna of the present invention. FIG. 3*b* shows what the impedance locus looks like if the antenna is undercompensated. There is still some effect, but it is limited.

Figure 4A:
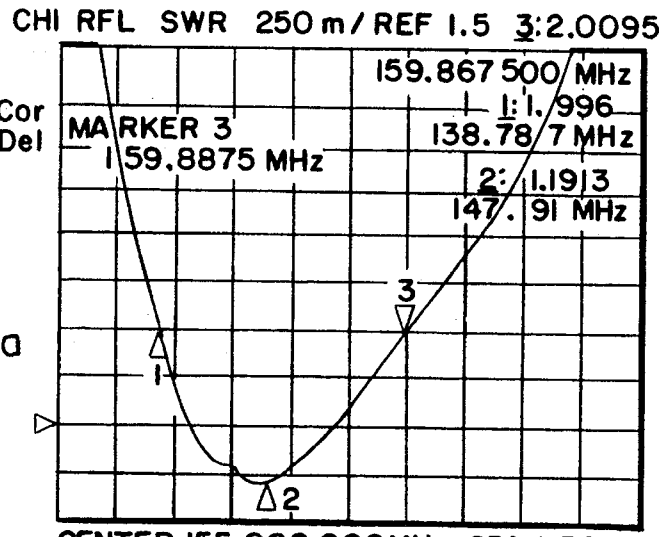
FIG. 4*a* shows a frequency response chart for the antenna alone of the present invention when operating in the VHF range.
Figure 4B:
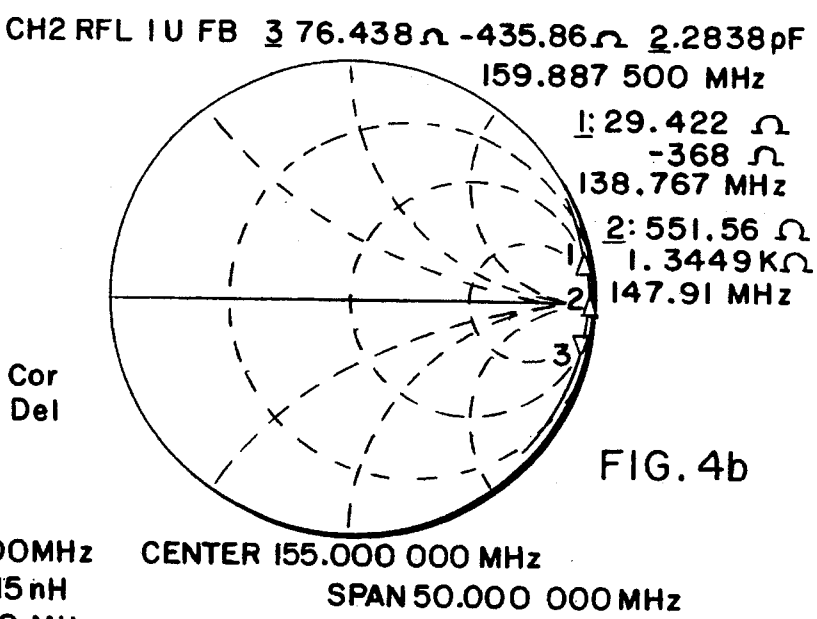
FIG. 4*b* shows a frequency response chart for the matching network alone and without an antenna when operating in the VHF range.
Figure 4C:
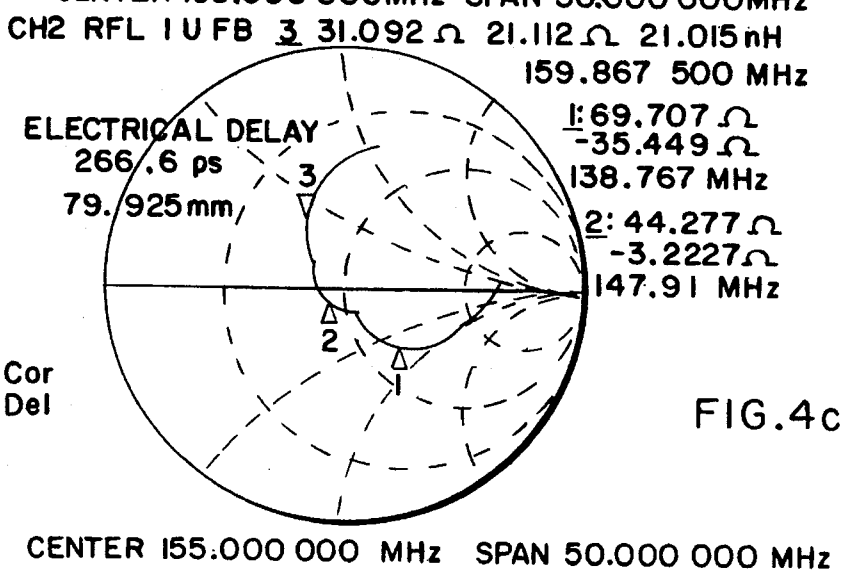
FIG. 4*c* shows a frequency response chart for the antenna with the matching network of the present invention when operating in the VHF range.

FIG. 4*a* shows the response of a VHF version of the present invention. The matching network without the antenna is shown in FIG. 4*b*, and the combined network is shown in FIG. 4*c*.

Figures 5A, 5B, 5C:
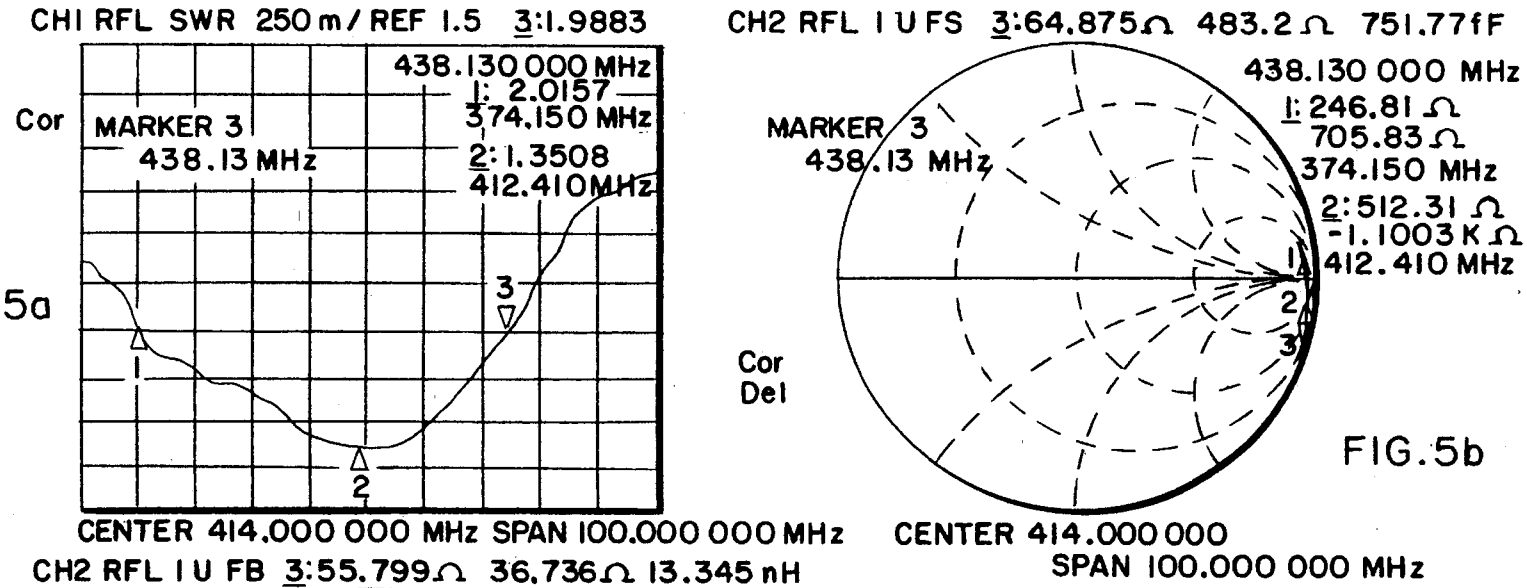
FIG. 5*a* shows a frequency response chart for the antenna alone of the present invention when operating in the UHF range.
FIG. 5*b* shows a frequency response chart for the matching network alone and without an antenna when operating in the UHF range.
FIG. 5*c* shows a frequency response chart for the antenna with the matching network of the present invention when operating in the UHF range.

FIG. 5*a* shows the response of a UHF version of the present invention with Figures 5*b* and 5*c* showing the matching network without the antenna and the combined network responses, respectively.

While the present invention has been described with regards to particular embodiments, it is recognized that additional variations of the present invention may be devised without departing from the inventive concept.

What I claim is:

1.A wide-banded base station antenna, comprising:

a metal sleeve, said metal sleeve being one-quarter wavelength or less of signals to be transmitted by the antenna;

a center conductor, said center conductor coaxial to and surrounded by said metal sleeve;

said metal sleeve and said center conductor forming a fifty ohm (50 Ω) coaxial transmission line;

an exposed metal radiator, said radiator held by an insulator to said sleeve in such proximity as to create a fringe capacitance between said radiator and said sleeve;

an inductor, said inductor electrically connected to said radiator and said center conductor; and a second conductor electrically connecting said inductor to ground in parallel with said center conductor; whereby said inductor acts as a power divider and forms an "L" network in conjunction with said fringe capacitance to broaden the bandwidth of the antenna.

2. The wide-banded base station antenna of claim 1, wherein:

said inductor is tapped at one end and off center by said second conductor;

said inductor is electrically connected at a step-up end to said radiator; and said inductor is electrically connected at a primary end to said center conductor.

3. The wide-banded base station antenna of claim 2, wherein said second conductor gives rise to a mutual inductance.

4. The wide-banded base station antenna of claim 2, wherein said second conductor does not give rise to a mutual inductance.

5. The wide-banded base station antenna of claim 2, wherein said inductor is within said sleeve and protected from the weather.

6. A wide-banded base station antenna, comprising:

a metal sleeve, said metal sleeve being one-quarter wavelength or less of signals to be transmitted by the antenna;

a center conductor, said center conductor coaxial to and surrounded by said metal sleeve;

said metal sleeve and said center conductor forming a fifty ohm (50 Ω) coaxial transmission line;

an exposed metal radiator, said radiator held by an insulator to said sleeve in such proximity as to create a fringe capacitance between said radiator and said sleeve;

an inductor, said inductor electrically connected to said radiator and said center conductor, said inductor electrically connected at a step-up end to said radiator, said inductor electrically connected at a primary end to said center conductor, and said inductor positioned within said sleeve and protected from the elements; and a second conductor electrically connecting said inductor to ground in parallel with said center conductor, said inductor tapped at one end and off center by said second conductor; whereby said inductor acts as a power divider and forms an "L" network in conjunction with said fringe capacitance to broaden the bandwidth of the antenna, and eliminates the need to adjust the network for frequency response.

7. The wide-banded base station antenna of claim 6, wherein said second conductor gives rise to a mutual inductance.

8. The wide-banded base station antenna of claim 6, wherein said second conductor does not give rise to a mutual inductance.

* * * * *